United States Patent [19]

Conrad

[11] 4,420,665

[45] Dec. 13, 1983

[54] MOISTURE PROOF SWITCH ASSEMBLY

[76] Inventor: Richard A. Conrad, 1422 Phillips St., Vista, Calif. 92083

[21] Appl. No.: 418,441

[22] Filed: Sep. 15, 1982

[51] Int. Cl.[3] ..... H01H 13/06

[52] U.S. Cl. ..... 200/302; 200/250; 200/275; 200/243

[58] Field of Search ..... 200/302, 340, 159 B, 200/275, 159 R, 159 A, 243, 245, 247, 250, 251; 277/167.5

[56] References Cited

U.S. PATENT DOCUMENTS

| | | | |
|---|---|---|---|
| 2,200,151 | 5/1940 | Burkhardt | 277/167.5 |
| 2,740,023 | 3/1956 | Kryder | 200/302 |
| 4,023,002 | 5/1977 | Wuthrich et al. | 200/302 |
| 4,031,348 | 5/1977 | Eberhardt | 200/302 |
| 4,259,551 | 8/1981 | Ohtani et al. | 200/302 |
| 4,366,355 | 12/1982 | Oelsch | 200/159 B |

FOREIGN PATENT DOCUMENTS

| | | | |
|---|---|---|---|
| 2344945 | 11/1977 | France | 200/302 |
| 2046,996 | 11/1980 | United Kingdom | 200/340 |

*Primary Examiner*—Charles E. Phillips
*Assistant Examiner*—Ernest G. Cusick
*Attorney, Agent, or Firm*—Fred N. Schwend

[57] ABSTRACT

A moisture proof switch in which an elastomeric O-ring is interposed between a push button and a switch housing. The O-ring is normally held in partial compression to prevent entrance of moisture, etc. into the housing and to normally hold a switch contact member out of engagement with contacts carried by the housing. Depression of the push button further compresses the O-ring to close the switch.

8 Claims, 6 Drawing Figures

FIG. 1.
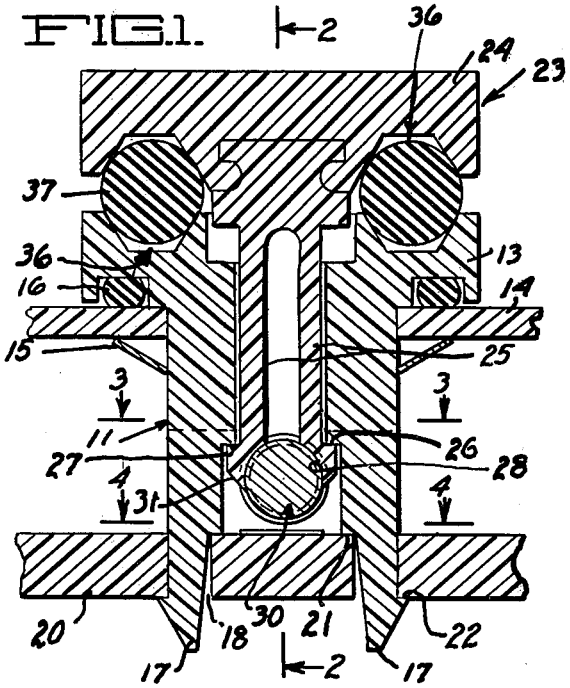
FIG. 2.
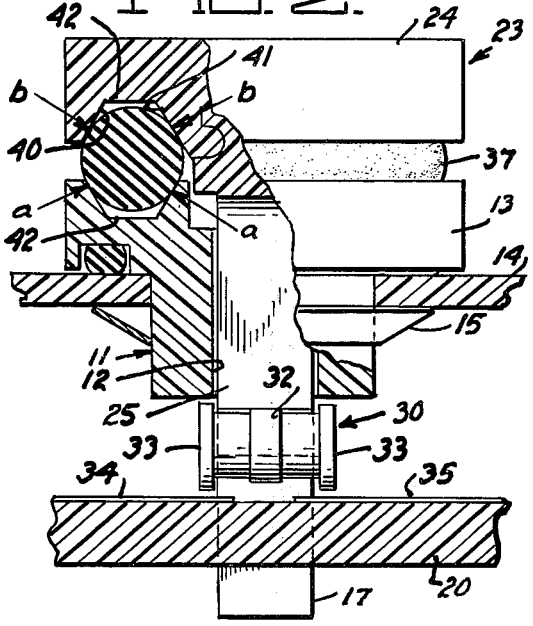
FIG. 3.
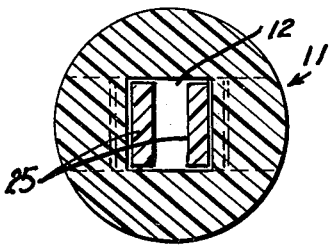
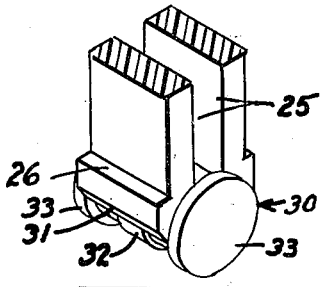
FIG. 5.
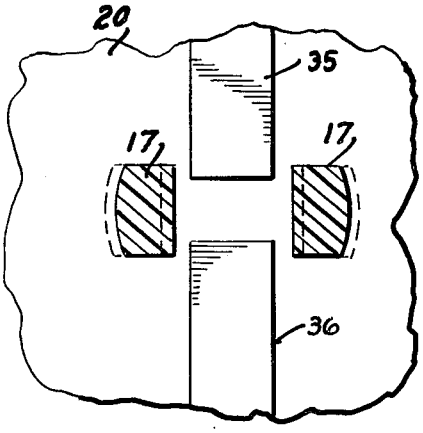
FIG. 4.
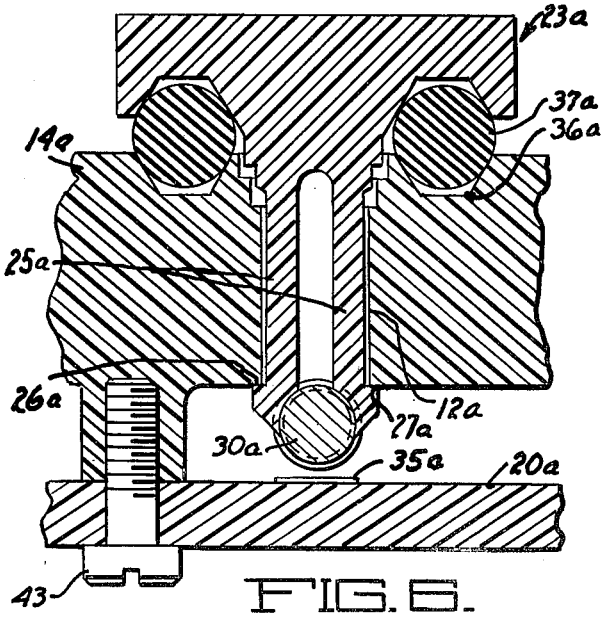
FIG. 6.

MOISTURE PROOF SWITCH ASSEMBLY

BACKGROUND OF THE INVENTION

1. Field of the Invention

This invention relates to electric switches and has particular reference to moisture proof push button switches.

2. Description of the Prior Art

Electrical equipment controlled by push button switches is often used outdoors or in other environments where moisture and other switch contaminents, such as dust, are present. Since moisture and the like is detrimental to electrical equipment, and particularly to low voltage level electrical switch contacts, it is highly desirable to prevent moisture, etc., from reaching the switch contacts as well as other parts of the equipment.

Although moisture proof switches have been available heretofore, those of which I am familiar and which are satisfactory for this purpose are relatively complicated, or have a large number of parts or are expensive to manufacture and assemble.

It therefore becomes the principal object of the present invention to provide a moisture proof push button switch which is simple and relatively inexpensive to manufacture and assemble.

Another object of the invention is to provide a switch of the above type which has a minimum number of parts.

Another object of the invention is to provide switch of the above type which is particularly applicable for use in connection with printed circuit boards.

Another object is to provide a switch of the above type in which the push button is always oriented in fixed relation to the switch body whereby any legends or indicia on the push button also remain properly oriented.

SUMMARY OF THE INVENTION

According to the invention, the present switch comprises means forming a housing for switch contacts. A push button member is provided in front of the housing and has a pair of spring jaws extending therefrom which resiliently grip a contact member effective to bridge the contacts. An annular sealing member of elastomeric material is fitted between the housing and the push button and is normally held under compressive stress by virture of interlocking shoulders on the spring jaws and on the housing. Thus, the sealing member seals the switch to prevent moisture, etc. from entering the housing. Depression of the push button further compresses the sealing member and carries the contact member into switching engagement with the contacts. The contact member is held in place by the resilient action of the jaws, and when so held prevents relative disengagement of the interlocking shoulders.

BRIEF DESCRIPTION OF THE DRAWING

The manner in which the above and other objects of the invention are accomplished will be readily understood in reference to the following specification when read in conjunction with the accompanying drawing, wherein:

FIG. 1 is a longitudinal sectional view of a push button switch embodying a preferred form of the present invention.

FIG. 2 is a partial sectional view taken along the line 2—2 of FIG. 1.

FIG. 3 is a sectional plan view taken along the line 3—3 of FIG. 1.

FIG. 4 is a sectional plan view taken along the line 4—4 of FIG. 1.

FIG. 5 is a perspective view of the lower portion of the switch member.

FIG. 6 is a sectional view, similar to FIG. 1, of a modified form of the present invention.

DESCRIPTION OF THE PREFERRED EMBODIMENT

Referring to FIGS. 1 to 5, the switch disclosed therein comprises a cylindrical housing body generally indicated at 11, preferably of molded plastic. The latter has a bore 12 of square cross section extending axially therethrough. The upper end of the body 11 is enlarged to form a head 13.

The housing body 11 is fitted within an opening formed in a panel 14 and is preferably secured therein by a conical spring washer 15 which frictionally engages the outer surface of the body 11. A resilient O-ring 16 is fitted within an annular groove in the head 13 to seal against entry of moisture between the body 11 and the panel 14.

A pair of diametrically opposed resilient locking fingers 17 are formed integrally with the body 11 and are snapped into openings 18 formed in a printed circuit board 20 which extends parallel to the panel 14. Shoulders 21 on the inner sides of the fingers and shoulders 22 on the outer sides of the fingers interlock with the board 20 to secure the switch body 11 to the board.

A push button switch member generally indicated at 23 is provided comprising a push button portion 24 and a pair of spring jaws 25 integrally united therewith. The push button portion 24 and spring jaws 25 are preferably of molded plastic. The push button portion 24 may be either insert molded into integral relation with the jaws, as indicated in FIGS. 1 and 2, or they may all be initially molded as a single part.

Latching shoulders 26 are formed on the jaws 25 to interlock with latching shoulders 27 on the body 11 at the lower end of the bore 12. Concave bearing portions 28 are formed on the lower ends of the jaws 25 to receive and hold a cylindrical contact member 30 of brass or similar conductive material. The jaws 25 terminate in inclined shoulders 31.

The contact member 30 has an enlarged central cylindrical portion 32 (FIG. 2) which is resiliently gripped by bearing portions 28 of the jaws 25 and also has an enlarged cylindrical contact portions 33 at opposite ends which are adapted to engage respective contacts formed by conductors 34 and 35 provided on the upper surface of the board 20, when the push button member 23 is depressed.

Facing annular grooves 36 are formed in the housing head 13 and in the push button 24 to receive a resilient O-ring 37 of elastomeric material, such as rubber. The latter is relatively soft and preferably has a durometer rating on the order of 30 Shore hardness.

The interlocking shoulders 26 and 27 are preferably so located that they hold the O-ring 37 in partial compression so as to seal the interior of the housing body from entrance of moisture. Thus, also, the O-ring 37 normally maintains the push button member 23 in its upper position, illustrated in FIGS. 1 and 2, to maintain the contact member 30 out of engagement with the conductors 34 and 35. However, when the push button portion 24 is depressed, the O-ring 37 will further compress, causing the contact member 30 to close the switch.

It will be noted that the enlarged central portion 32 of the contact member 30 permits a slight rocking movement of the switch member about a mid-point in the concave bearing portions 28 of the jaws 25. Thus, the cylindrical contact portions 33 of the contact member 30 will engage the conductors 34 and 35 with equal force even though the latter may not be precisely level with each other.

In assemblying the switch, the O-ring 37 is located in place and the push button member 23 is then loosely inserted in the bore 12 with the contact member 30 removed. During insertion, the inclined surfaces 31 cam along the interior of bore 12 to inwardly compress the jaws 25 until the latching shoulders 26 snap into interlocking engagement with locking shoulders 27. Thereafter, the contact member 30 is snapped into the concave bearing portions 28 of the jaws to prevent accidental release of the push button member 23. The housing body 11 is then fitted in the panel 14 and the spring fingers 17 are snapped into the holes 18 in the circuit board 20.

It will be noted that considerable clearance exists between the jaws 25 and the interior of the bore 12. Thus, the fitting of the O-ring 37 in the grooves 36 is mainly effective to center the jaws 25 in the housing body 11. Thus, the push button member 23 may be freely actuated despite relatively large dimensional tolerances in the housing body and in the push button member.

It will be further noted that the cross sectional shape of each of the O-ring grooves 36 is formed of straight sides 40 and 41 which converge away from the O-ring 37 and are connected by a floor 42 which is spaced away from the outer periphery of the O-ring 37, even when the latter is compressed. Thus, when the O-ring 37 is compressed, a portion thereof will move into the space between the same and the floor 42 of the groove. Also, in view of such groove formation, compression of the O-ring 37 will mainly occur in the direction of the arrows a and b of FIG. 1 so that direct compression of the O-ring in a direction parallel to its axis is prevented which results in a more desirable and constant degree of spring action when the push button member 23 is depressed.

DESCRIPTION OF THE MODIFIED EMBODIMENT

FIG. 6 illustrates a modified form of the invention in which a panel 14*a* has a bore 12*a* and an O-ring groove 36*a* formed directly therein to provide a switch housing for a push button switch member 23*a*, the latter being similar to the push button member 23 of FIGS. 1 and 2. In this case, a printed circuit board 20*a* is held in spaced relation to the panel 14*a* by screws, one of which is shown at 43.

An O-ring 37*a* is normally held in partial compression by shoulders 26*a* formed on jaws 25*a* of the push button member 23*a*, which shoulders interlock with the under surface of the panel 14*a*. Thus, depression of the push button member will further compress the O-ring 37*a* to move contact member 30*a* into bridging engagement with conductors on the circuit board 20*a*, one of which is shown at 35*a*.

It should be noted that by virture of the square cross section of the bore 12*a* and similar shape of the jaws 25*a*, the push button member 23*a* will always be properly oriented relative to the panel 14*a* so that any legend or indicia on the push button member will likewise be properly oriented.

I claim:

1. A moisture proof switch assembly comprising housing means,
   a pair of electrical contacts carried by said housing means,
   a switch member including a push button portion and a pair of jaws extending from said push button portion into said housing means,
   an electric contact member removably carried by said jaws,
   an annular sealing member of elastomeric material surrounding said jaws and interposed between said housing means and said push button portion,
   at least one locking shoulder on said housing means,
   a latching shoulder on at least one of said jaws engagable with said locking shoulder for maintaining said sealing member compressed between said housing means and said push button portion whereby to seal said housing means from entrance of moisture therein,
   said push button portion being depressible whereby to further compress said sealing member and to cause said contact member to engage said contacts,
   one of said jaws being flexible relative to the other to disengage said latching shoulder from said locking shoulder, and
   said contact member when carried by said jaws preventing said one jaw from disengaging said latching shoulder from said locking shoulder.

2. A moisture proof switch assembly as defined in claim 1 wherein said sealing member comprises an O-ring, and
   said housing means and said push button portion having interfacing annular grooves therein to receive said O-ring.

3. A moisture proof switch assembly as defined in claim 2 wherein each of said grooves has a cross section comprising rectilinear sides which converge away from said O-ring.

4. A moisture proof switch assembly as defined in claim 1 comprising
   two of said locking shoulders on said housing means,
   latching shoulders on both of said jaws engagable with respective ones of said locking shoulders, and
   both of said jaws being flexible relative to each other.

5. A moisture proof switch assembly as defined in claim 4 wherein said contact member has an enlarged diameter mid section,
   said mid section fitting within said bearing portions whereby said contact member may rock about a point intermediate the length thereof to cause said contact member to engage said contacts with equal force.

6. A moisture proof switch assembly as defined in claim 1 wherein said jaws have facing concave bearing portions therein, and
   said contact member being cylindrical and fitting within said bearing portion.

7. A moisture proof switch assembly as defined in claim 1 wherein said housing means comprises a pair of spaced panels,
   an opening in one of said panels, a housing body fitted in said opening,
said body having a bore therein to receive said jaws,
said contacts being mounted on the other of said panels, and
means for securing said body to one of said panels.

8. A moisture proof switch assembly as defined in claim 7 wherein said securing means comprises flexible hook elements extending endwise from said body and engaging in openings in the other of said panels.

* * * * *